US005099785A

United States Patent [19]

Reed

[11] Patent Number: 5,099,785

[45] Date of Patent: Mar. 31, 1992

[54] TAMPER PROOF LIQUID SOAP DISPENSER

[76] Inventor: Donald J. Reed, 27550 Clark Rd., Wellington, Ohio 44090

[21] Appl. No.: 581,675

[22] Filed: Sep. 13, 1990

[51] Int. Cl.[5] ..... B05C 1/00

[52] U.S. Cl. ..... 118/258; 118/244; 248/507; 403/188; 403/245

[58] Field of Search ..... 222/167, 169, 171, 180, 222/181, 185, 173, 405, 410, 414; 401/48, 208; 403/245, 246, 199, 188; 248/314, 507; 118/244, 258

[56] References Cited

U.S. PATENT DOCUMENTS

| | | | |
|---|---|---|---|
| 253,053 | 1/1882 | Hudson | 403/245 X |
| 852,602 | 5/1907 | Hanlon . | |
| 853,405 | 5/1907 | Godward | 222/169 X |
| 989,685 | 4/1911 | Zittle et al. | 118/258 |
| 1,240,279 | 9/1917 | Wilson | 118/258 X |
| 1,741,587 | 12/1929 | Schau | 403/246 |
| 2,336,073 | 12/1943 | Cloutier | 118/258 X |
| 2,541,396 | 2/1951 | Winkler et al. | 118/258 |
| 3,096,913 | 7/1963 | Corley | 222/181 X |
| 3,217,939 | 11/1965 | Murray | 222/167 |
| 4,110,944 | 9/1978 | Carlson | 403/199 X |
| 4,643,607 | 2/1987 | Caudill et al. | 403/246 X |
| 4,792,064 | 12/1988 | Loesel, Jr. et al. | 222/181 |

*Primary Examiner*—Kevin P. Shaver
*Attorney, Agent, or Firm*—Gustalo Nunez

[57] ABSTRACT

A tamper proof dispenser containing liquid soap or a liquid detergent including a cylindrical housing having an opening at the top portion thereof and a rotating liquid soap dispensing drum housed within said cylindrical housing with a portion of the dispensing drum being exposed at the opening located at the top portion of the cylindrical housing. In operation, the dispensing drum is rotated about its axis and soap adheres to the surface of the dispensing drum as it passes through the liquid soap. At the time the soap coated surface of the dispensing drum reaches the opening at the top portion of the cylindrical housing, the user's hand will contact the surface of the dispensing drum and hence, soap will be transmitted to the hand.

4 Claims, 4 Drawing Sheets

TAMPER PROOF LIQUID SOAP DISPENSER

BACKGROUND OF THE INVENTION

1. Field of the Invention

The invention is directed to a dispenser of liquids, such as liquid soap and in which the construction of the dispenser is such that it is highly protected from being tampered with.

2. Description of the Prior Art

Liquid soap dispensers are well known. Many include a reservoir containing the liquid with a release push button which releases soap by means of gravity. Others utilize pressurized bladders for causing the release of the liquid soap.

U.S. Pat. No. 4,792,064 discloses a liquid soap dispenser in which the liquid soap is contained in a compressible reservoir. Compressing the reservoir causes the liquid soap to be released.

U.S. Pat. No. 852,603 discloses a soap dispenser in which the soap is contained in a reservoir which is elevated with respect to the outlet portion. Turning the outlet release results in soap being gravity fed to a container which is rotatable with respect to the outlet. A complete rotation results in the soap being dispensed to the user.

However, none of the prior art is directed to a soap dispenser which is highly resistant to tampering, nor to a soap dispenser which applies the soap only to the hands and finger, and not to the sink, floor, etc.

SUMMARY OF THE INVENTION

The present invention is directed to an improved tamper proof liquid soap dispenser which is durable in construction and relatively simple in structure. The present invention comprises a liquid reservoir, completely closed except for one opening. The liquid reservoir is generally an elongated cylindrical housing member which is open on one portion thereof, the opening being positioned such that when the cylindrical housing member is held in a generally horizontal position, the opening is located at the top portion thereof. The cylindrical housing member is, except for the opening portion thereof, completely sealed, i.e. no threads nor any weld marks are exposed.

Located inside the cylindrical housing member is a rotating dispensing cylinder. The axis of the dispensing cylinder and the axis of the cylindrical housing member are coincident with respect to each other.

The rotating dispensing cylinder is provided with a fill opening which is used to introduce the liquid substance into the cylindrical housing member. At such time that the liquid soap is introduced into the cylindrical housing member by means of a fill aperture located on the dispensing cylinder, the dispensing cylinder will then be immersed in said liquid soap.

In practice, the instant liquid soap dispenser may be attached to the wall or other stable structure. The unique means for attaching the liquid soap dispenser described herein renders its removal by unauthorized persons extremely difficult.

When attached and ready to use, the open portion of the cylindrical housing member will be facing in an upwardly direction. The cylindrical housing member is attached to the wall member in a rather unique fashion which will be described in detail later in this specification. Filling the cylindrical housing member with liquid soap renders the liquid soap dispenser ready for use.

The liquid soap dispenser dispenses the soap required by the user. It allows the application of soap only to the hands; not the sink, not the floor. To use the liquid soap dispenser, the user simply places his hand on the dispensing cylinder and causes it to rotate. The rotating dispensing cylinder, which in effect is similar to a rotating drum, passes through the liquid soap bath resulting in soap being applied to the surface of the rotating drum. At the time that the soap coated rolling drum surface reaches the top open portion of the cylindrical housing member, the user simply needs to place his hand, palm or fingers, on the drum surface. This results in soap being applied to the palm and fingers in an even fashion.

A primary object of the invention is to provide a liquid soap dispenser that can be used anywhere and which is relatively tamper proof. A secondary object is to provide a liquid dispenser that can include a deodorizing fluid as well. An ideal placement for the liquid soap dispenser would be in the school setting. It is well known that school property and equipment is vandalized on a regular basis. For example, last year alone approximately $5,000,000.00 was spent on soap dispensers in Ohio schools. This is an ongoing expense as a result of vandalism committed on the flimsy plastic and sheet metal dispensers presently being used. This vandalism helps reduce school treasuries and also denies students the means by which to practice good hygiene because of missing soap dispensers. The instant invention helps to relieve the above situation.

The instant invention, both as to its structure and use, along with the advantages thereof, will best be understood with reference to the following specification taken in connection with the accompanying drawings.

DESCRIPTION OF THE PREFERRED EMBODIMENT

Figure 1:
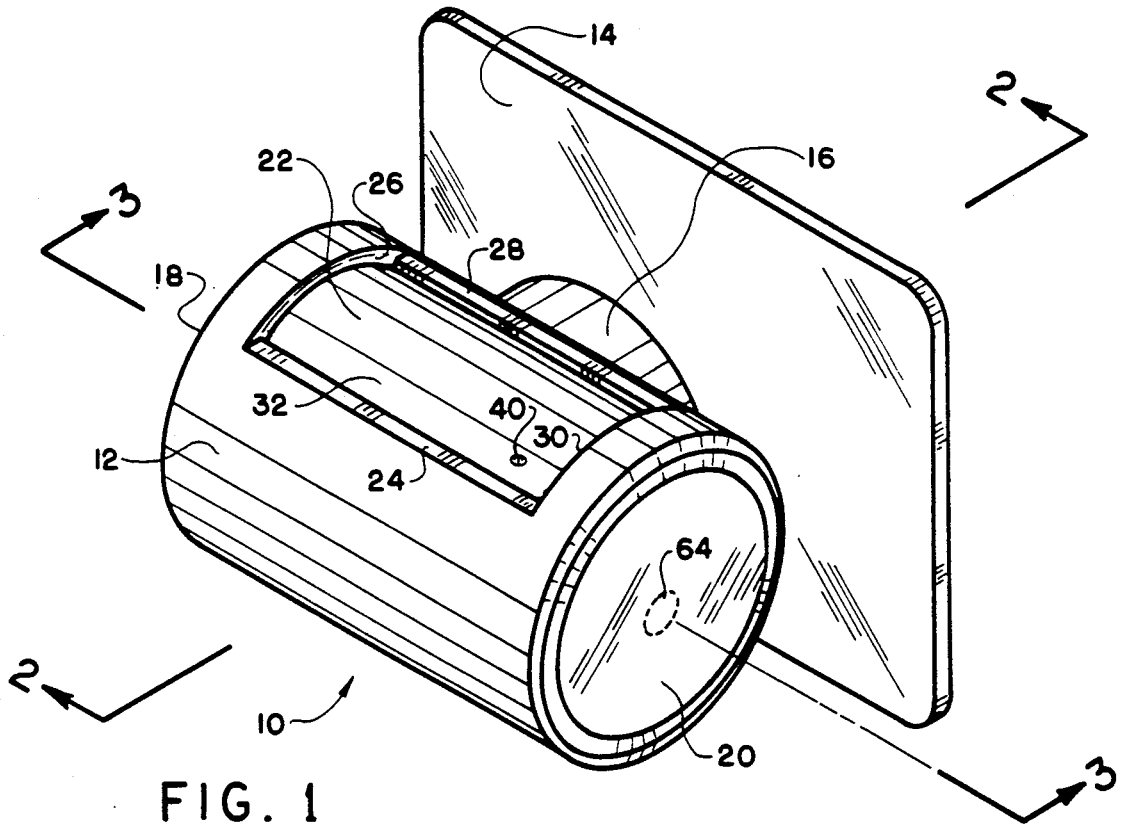
FIG. 1 is a perspective view of the liquid dispenser and the associated wall mounting assembly.

Referring to FIG. 1 of the drawings, there is shown a dispenser 10 for dispensing liquids such as liquid soap, said dispenser 10 made in accordance with and embodying the principles of the present invention. An enclosed elongated cylindrical housing member 12 is shown attached to a wall member 14 by means of an extending wall attachment 16. The housing member 12 further includes first and second side walls 18 and 20 and an open portion 22 at the top portion thereof. The open portion 22 is defined by the edges 24, 26, 28 and 30 which are machined onto the cylindrical housing member 12. The edges 24 and 28 are machined in a fashion such that the edge surfaces lie generally in the same plane, said plane being generally normal to the surface of the wall member 14.

Housed within the cylindrical housing member 12 is an elongated cylindrical drum 32. The outside diameter of the cylindrical drum 32 is such that it has freedom to rotate within the cylindrical housing member 12. The drum 32 is terminated at each end with a bearing 34 having an opening at 36. A shaft 38, whose length is longer than the length of the drum cylinder 32, such that shaft 38 extends throughout the length of the cylindrical drum 32 and on through the openings 36 of both bearing members 34. Also located on the surface of the cylindrical drum 32 is an aperture 40 whose purpose will be described later in this specification.

Figure 4:
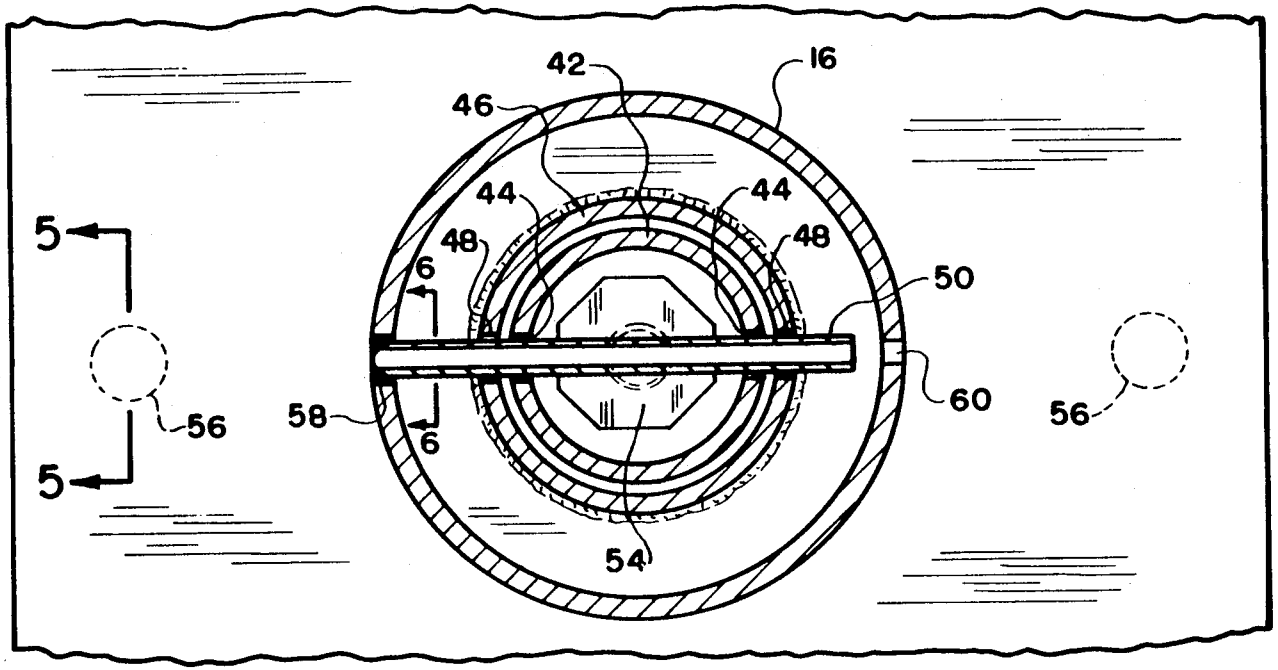
FIG. 4 is a cross-sectional view of the liquid dispenser wall attachment assembly taken along line 4—4 of FIG. 2.
Figure 6:
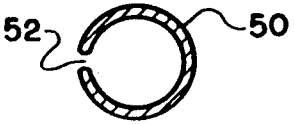
FIG. 6 is a cross-sectional view of the locking key taken along line 6—6 of FIG. 4.
Figure 5:
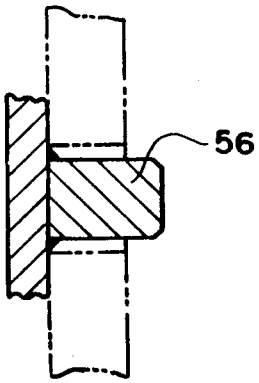
FIG. 5 is a cross-sectional view of the liquid dispenser locating pins taken along line 5—5 of FIG. 4.

The extending wall attachment 16 has concentrically disposed within its interior an outwardly extending tube 42. The tube 42 has a pair of opposing apertures 44 disposed thereon. The wall member 14 has integral thereto an outwardly extending tube 46 designed to receive and enclose the tube member 42. Tube member 46 has a pair of opposing apertures 48 disposed thereon, such that the apertures 44 and 48 can be placed in direct alignment with each other and locked in place with an extending locking key 50 which is an elongated cylindrical tube having a slot 52 throughout the entire length thereof. Referring to FIG. 4, it can be seen that the extending wall attachment 16 also has disposed thereon, a pair of opposing apertures 58 and 60 which are placed in alignment with the apertures 44 and 48. Thus it can be seen that the key extends through apertures 58, 48 and 44. Aperture 60 is of a smaller diameter than those of apertures 58, 48 and 44 in order to make it more difficult for vandals to remove the liquid soap dispenser; specifically, the cylindrical housing member 12 from the wall member 14. It would take a special tool to remove the locking key 50 because aperture 60 is not designed to receive the locking key 50, which therefore increases the degree of difficulty in removing the housing member 12. In the preferred embodiment, the aperture is designed to be used with a special tool to remove the cylindrical housing member 12 from the wall attachment 14.

Also, it is noted that the aperture 60 need not be disposed on the side member 16. In this fashion the liquid soap dispenser 10 could not be removed from the wall member 14 without destroying the wall on which the dispenser 10 is placed. Short of that, it would require the use of a drill for the purpose of drilling a hole on the extending tube member 16, in a line coincident with the locking key 50 which would then enable the vandal to remove the locking key 50. This feature renders the liquid soap dispenser almost totally tamper proof. Of course, nothing is ever 100% totally tamper proof, but the just described liquid soap dispenser 10 comes fairly close to that standard. The wall member 14 is affixed to the bathroom wall by means of mounting bolts 54 and studs 56 which are preferably positioned on wall studs or masonry for extra support.

The side walls 18 and 20 may be adapted to receive "O" rings (not shown) which extend over the circumference of the side walls 18 and 20 and which would ride on shoulder 68. The side walls 18 and 20 are then placed onto the shaft 38, said bearing extending almost to the outside surface of the side walls 18 and 20. The side walls, with the shaft 38 in place, are then press fitted onto the ends of the cylindrical housing 12. The "O" rings provide additional security from leakage through the portion where the side walls 18 and 20 engage the cylindrical housing 12. The "O" ring could be used in those situations when the side walls 18 and 20 are held in place by plugwelds 66 at the ends of shaft 38. The wall attaching means 16 and the concentric rings are simply welded onto the cylindrical housing 12 in a conventional manner.

As can be seen from the references to weld lines, the preferred material to be used in manufacturing the liquid soap dispenser 10 would be a metal such as stainless steel. Of course it could be manufactured out of other materials such as heavy duty plastics but such a departure would depreciate the tamper proof qualities of the liquid soap dispenser 10.

Figure 2:
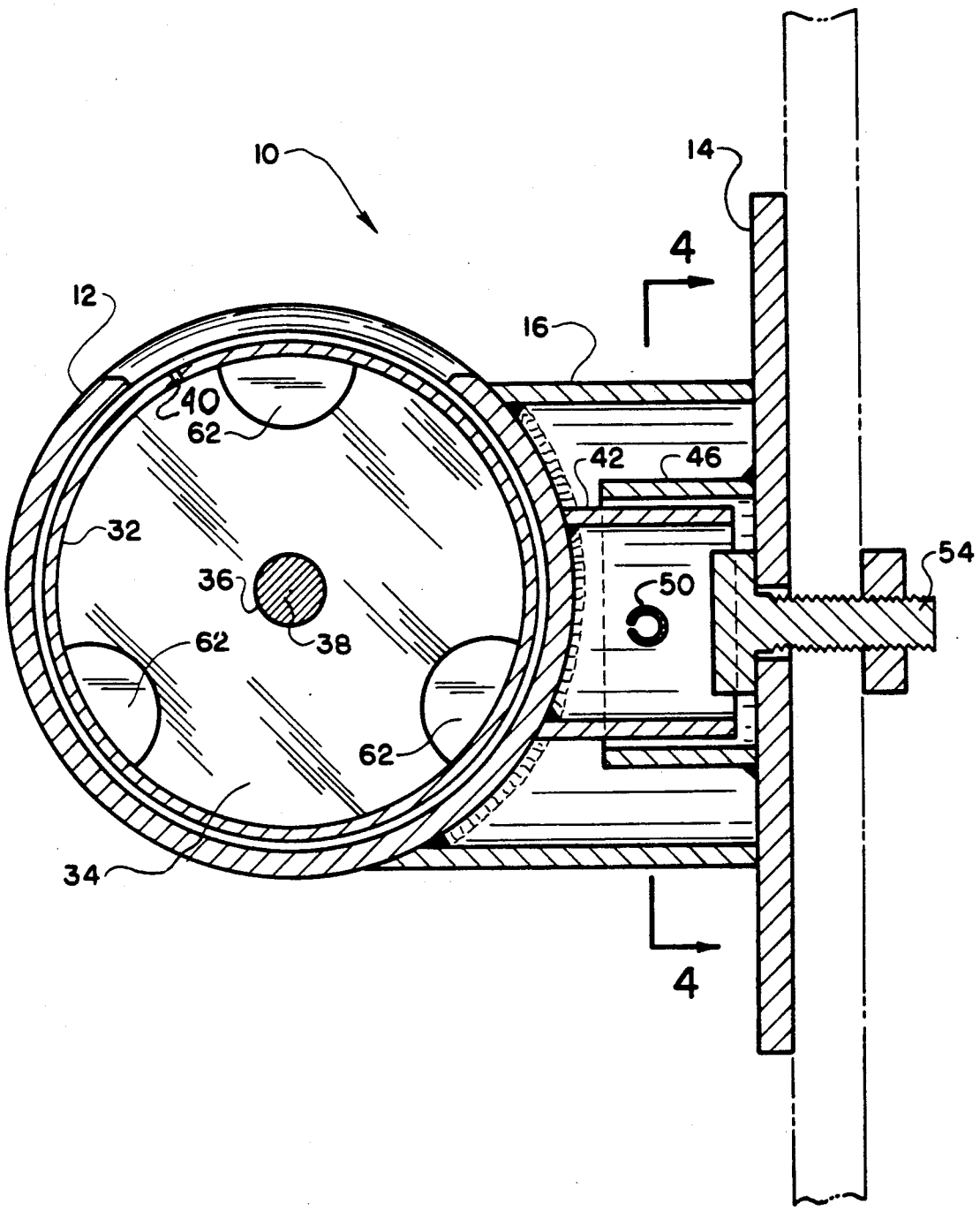
FIG. 2 is a cross-sectional view of the liquid dispenser taken along line 2—2.
Figure 3:
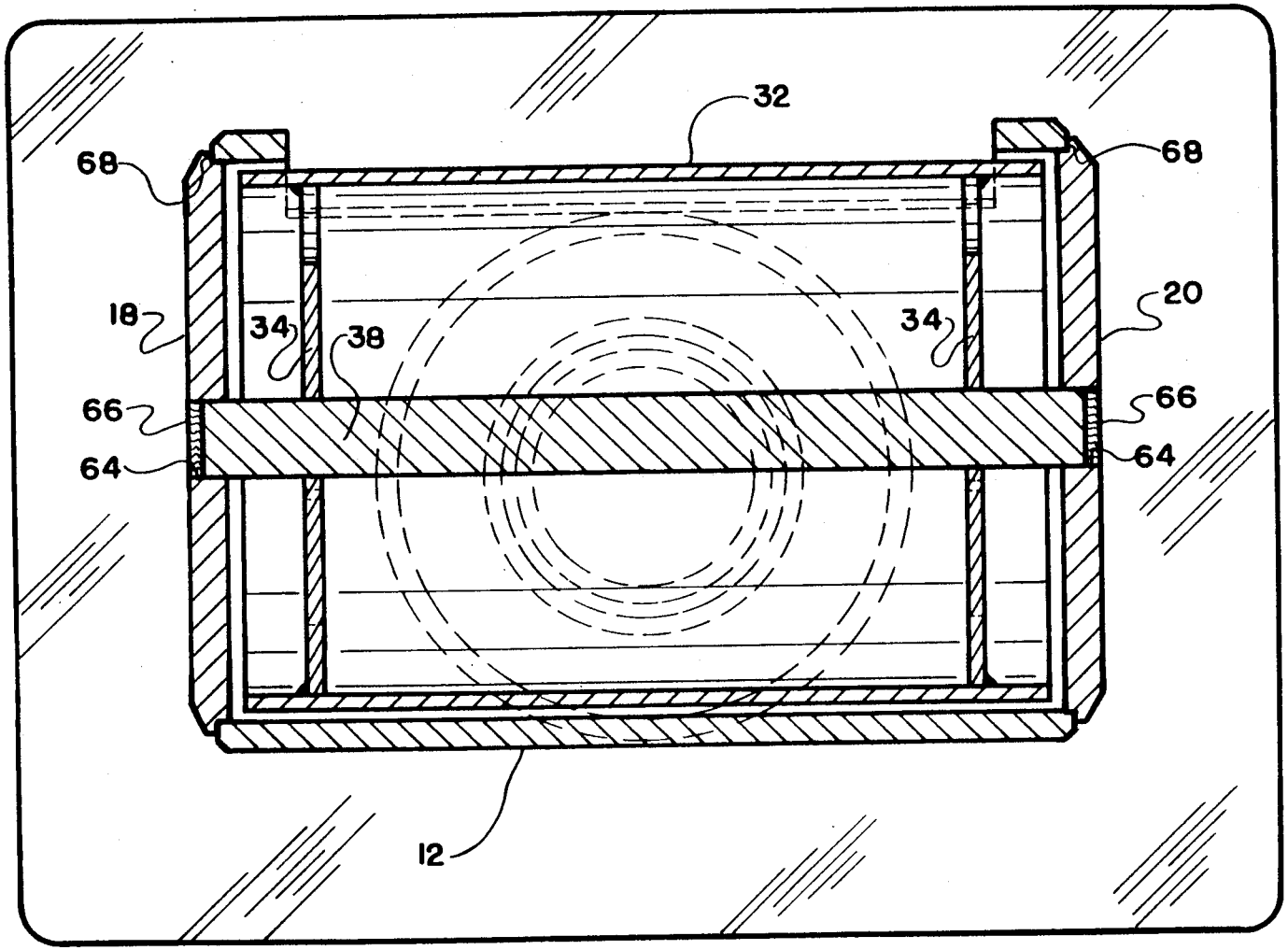
FIG. 3 is a cross-sectional view of the liquid dispenser taken along line 3—3.

Although the bearing member 34 is shown in FIG. 2 as a solid circular structure with several recesses 62 at the extremities, the bearing member could easily comprise a plurality of spokes connected at the centermost section to a hub and at the other end to the cylindrical drum 32.

In operation, the cylindrical housing member is filled with liquid soap by means of the aperture 40. It can be filled by pouring soap through the aperture, which would take time, or placing the liquid soap under pressure. This can be done simply and quickly by placing liquid soap in a tank and pressurizing the tank. The tank can be equipped with a flexible outlet such as a hose terminating in a needle suitable for insertion into the aperture 40. The liquid soap is introduced into the reservoir formed by the cylindrical housing member 12 until such time that the soap is seen coming out onto the drum surface 32 exposed at the opening 22.

In order for the user of the liquid soap dispenser 10 to get soap on his hands, the user only needs to place a palm on the exposed drum 32 surface and rotate it until such time that the dispensing drum surface comes about with soap adhered to the drum 32 surface. The user then simply wipes the palm and finger across the drum 32 surface which transfers the soap onto the user's hand and fingers. There is no mess, no dripping, and no waste. What soap is not wiped off the dispensing drum 32 surface will eventually find its way back into the reservoir formed by the cylindrical housing 12.

As can be seen, the liquid soap dispenser 10 is completely sealed excepting the open top portion 22. The question regarding cleaning comes to mind. Again, the aperture 40 comes into play. One needs only to introduce pressurized water, e.g. water from the sink tap, into the interior of the cylindrical housing 12 until such time that clear, clean water is seen flowing over the edges 24 and 28. In order not to create a mess, one only needs to place a receptacle under the liquid soap dispenser to catch the expelled liquid. At the time that clean water is observed, the hose is disconnected from the water tap faucet and the water yet held in the cylindrical housing member 12 will begin to siphon out so long as the end of the hose is lower than the liquid soap dispenser 10. The open portion 22 is cut out of the cylindrical housing member 12 by conventional machine shop methods well known to those skilled in the art. The edges 24 and 28 are ground such that the plane described by the flat edges 24 and 28 are generally perpendicular to the wall portion 14. The cylindrical drum 32 is telescopically inserted into the cylindrical housing member 12.

What is claimed is:

1. A liquid containing dispensing apparatus comprising:

an elongated generally cylindrical liquid reservoir including an open portion disposed thereon such that the open portion is positioned above a longitudinal axis defined by said liquid reservoir is in a generally horizontal position;

a rotating liquid drum dispenser rotatably secured within said elongated generally cylindrical liquid reservoir, wherein the axis of rotation of the liquid drum dispenser and the longitudinal axis of said liquid reservoir are coincident, said rotating liquid drum dispenser being provided with at least one aperture for the introduction of a liquid into said liquid reservoir, said rotating liquid drum dispenser being immersed in said liquid, said liquid dispensing drum, when actuated, rotates through said liquid such that said liquid adheres to said liquid dispensing drum and is the transmitted to a user's hand at the open portion disposed on said elongated generally cylindrical liquid reservoir;

wall attaching means including a plurality of outwardly extending tube members on said elongated generally cylindrical liquid reservoir and a tube member extending outwardly from a wall surface, wherein said outwardly extending tube members are fixedly locked in place with respect to each other by means of a locking key extending through said tube members.

2. A liquid dispensing apparatus comprising:

an elongated, generally cylindrical liquid containing tank, and having one open portion disposed thereon, such that said open portion defines a plane located above and parallel to a longitudinal axis defined by said elongated generally cylindrical liquid containing tank when said elongated generally cylindrical liquid containing tank is in a horizontal position;

a liquid dispensing drum securably and rotatably housed within said elongated general cylindrical liquid containing tank, said axis of rotation of said liquid dispensing drum being coincident with said longitudinal axis defined by said elongated generally cylindrical liquid containing tank, said dispensing drum being provided with at least one liquid filling aperture;

said elongated generally cylindrical liquid containing tank including at least a pair of outwardly concentric extending tubes, each tube provided with at least one aperture;

wall mounting means including an outwardly extending tube and being provided with at least one aperture, said outwardly extending tube being telescopically inserted within said pair of outwardly concentric extending tubes, to the extent that said apertures are in alignment for receiving an elongated locking key; said open portion on said cylindrical tank now being defined as the top portion of said generally cylindrical tank; and, whereby at such time that a user imposes a rotational movement to said liquid dispensing drum, said liquid dispensing drum rotates through said liquid, such that said liquid adheres to said liquid dispensing drum and applies said liquid to the user's hand at the open portion thereof.

3. A liquid containing dispensing apparatus comprising:

a first cylindrical tank having an opening at the uppermost portion thereof;

a second cylindrical tank open at both ends thereof and located within said first cylindrical tank and including bearing means for rotation of said second cylindrical tank within said first cylindrical tank, said first and second cylindrical tanks having coincident longitudinal axes, said second cylindrical tank including a filling aperture on at least one portion thereof for the introduction of a liquid into said first cylindrical tank;

said first cylindrical tank further including wall mounting means such that when mounted, said opening on said first cylindrical tank being above said longitudinal axis; and, whereby at such time that a user imposes a rotational movement to said second cylindrical tank, said liquid adheres to said second cylindrical tank and transfers said liquid to the user's hand at the open portion thereof.

4. A liquid containing dispensing apparatus comprising:

a cylindrical tube, closed at both ends thereof with first and second wall members, said first and second wall members provided with a recess at the centermost portion of said first and second wall members, said cylindrical tube having an elongated open portion disposed thereon and said cylindrical tube defining a longitudinal axis coincident with said recesses provided on said first and second wall members;

a liquid dispensing drum rotatably mounted within said cylindrical tube, said liquid dispensing drum rotating about a bearing member, said bearing member disposed within said recesses on said first and second wall members;

said cylindrical tube including at least one first outwardly extending tube, said longitudinal axis of said tube defining a plane parallel to a plane defined by the longitudinal sides of said open portion, said first outwardly extending tube further including diametrically opposed apertures;

wall mounting means including at least one second outwardly extending tube and being provided with a pair of diametrically opposed apertures;

said first and second extending tubes positioned immediately adjacent each other, such that said apertures are in alignment for receiving a rod type locking key, said open portion being positioned such that a plane defined by said open portion is perpendicular with respect to said wall mounting means; and, whereby at such time that a user imposes a rotational movement to said dispensing drum, said liquid dispensing drum rotates through said liquid, such that said liquid adheres to said dispensing drum and is transferred to the user's hand at the open portion thereof.

* * * * *